US007040127B2

(12) United States Patent
Kudo

(10) Patent No.: US 7,040,127 B2
(45) Date of Patent: May 9, 2006

(54) METHOD AND DEVICE FOR FORMING A PIPE

(75) Inventor: Takashi Kudo, Osaka (JP)

(73) Assignee: Kurimoto, Ltd., Osaka (JP)

( * ) Notice: Subject to any disclaimer, the term of this patent is extended or adjusted under 35 U.S.C. 154(b) by 59 days.

(21) Appl. No.: 10/808,413

(22) Filed: Mar. 25, 2004

(65) Prior Publication Data

US 2004/0187537 A1 Sep. 30, 2004

(30) Foreign Application Priority Data

Mar. 31, 2003 (JP) ..... 2003-095279

(51) Int. Cl.
*B21D 5/14* (2006.01)

(52) U.S. Cl. ..... 72/7.1; 72/173; 72/170

(58) Field of Classification Search ..... 72/7.1, 72/168, 170, 173, 174
See application file for complete search history.

(56) References Cited

U.S. PATENT DOCUMENTS 3,103,965 A * 9/1963 Savory ..... 72/169
3,197,990 A * 8/1965 Stubblefield ..... 72/131
3,693,391 A * 9/1972 Mori ..... 72/173
5,115,658 A * 5/1992 Kirchhoff et al. ..... 72/175
6,044,675 A * 4/2000 Davi ..... 72/7.1

FOREIGN PATENT DOCUMENTS

JP 63-36852 7/1988
JP 2000-288635 10/2000

* cited by examiner

*Primary Examiner*—Daniel C. Crane
(74) *Attorney, Agent, or Firm*—Wenderoth, Lind & Ponack, L.L.P.

(57) ABSTRACT

A method and a device are proposed which accurately and efficiently form a pipe with a bending machine only, without using any correcting devices. A plate having holes is fed into a bending machine in which under an upper roll, lower rolls parallel thereto are arranged, and a pipe is formed during a rough forming step and a fine forming step. In the rough forming step, bending is performed so that the plate will have a required diameter at hole portions. In the fine forming step, the hole portions are not pressed for bending while other portions are rolled so as to become closer to a required diameter to form the pipe.

20 Claims, 10 Drawing Sheets

METHOD AND DEVICE FOR FORMING A PIPE

BACKGROUND OF THE INVENTION

This invention relates to a method and a device for forming a pipe in which a plate with holes is formed into a completely circular pipe by use of a bending machine.

A method of forming a completely circular pipe by bending a steel plate by use of a bending machine has heretofore been performed with a bending machine in which one upper roll is vertically and horizontally movably arranged over two lower rolls arranged parallel to one another. A pipe forming method disclosed in JP patent publication 63-36852 is one example. This prior method comprises a preparatory step of bending a central portion, a main step and a step of bending both ends of a plate.

In the preparatory step of bending the central portion of the plate, the upper roll is lowered offset relative to the two lower rolls to a position where frictional force necessary for feed of the plate is obtained. Thereafter, the upper roll is further lowered while pressing and bending the plate for rolling the plate until a predetermined arc necessary for the main step is obtained. After performing the main step in which rolling is further performed with the predetermined arc, the both end bending step is performed in which pressing/bending is applied to both ends of the plate.

With this bending method, it is possible to bend a steel plate into a U-shape using part of its working steps. One example of such a method is proposed in JP patent publication 2000-288635. In this U-bending method, after moving a steel plate clamped between an upper roll and two lower rolls to a predetermined forming start position, the upper roll is lowered with a lowering amount divided into a plurality of portions so as to form a predetermined arc, while rotating the lower rolls in normal and reverse directions at rotating amounts corresponding to lowering amounts to perform multiple step formation while gradually narrowing each formation toward a minimum curvature portion.

Bending methods by use of the bending machines described in these two patent publications are used for flat plates in which no holes are formed. No mention is made about what influence holes being formed in a flat plate will have on work accuracy when forming the flat plate into a pipe. If a pipe is actually formed by applying the bending method of JP patent publication 63-36852 to a work with holes, it is known from experience that no normal bending is possible near portions where the holes are present, and a radius of curvature partially decreases at such portions and the pipe is not made to be completely circular.

Thus, in forming a pipe with holes, in order to obtain a completely circular pipe, a plate has to be treated by one of the following two methods. That is, the pipe forming method of JP patent publication 63-36852 is applied without forming any hole in the plate to form a completely circular pipe, and thereafter, holes are formed at predetermined positions by use of a drill. Otherwise, after a pipe has been formed by applying this pipe forming method to one in which holes have been formed in a work beforehand, bending is performed again with a different kind of press device to correct curvature of the pipe, which is out of true at hole portions.

But, simply by applying the pipe forming method of JP patent publication 63-36852, it is impossible to obtain a completely circular pipe. If holes are formed with a drill after forming a completely circular pipe, the pipe may become partially not completely circular due to influence of drilling. If a material formed with holes is formed into a pipe, it may develop portions which are partially not completely circular. Thus, it is necessary to perform bending again at such portions. Thus, extremely complicated steps are needed. So it is difficult to obtain a completely circular pipe with a bending machine alone. A different kind of machine and step are needed for correction.

An object of this invention is to provide a method and a device for accurately and efficiently forming a pipe with a bending machine only, without using correctional measures, by uniformly bending a plate with holes to a pipe diameter.

SUMMARY OF THE INVENTION

According to this invention, there is provided a method of forming a pipe comprising steps of: feeding a plate having a hole between an upper roll and a pair of lower rolls of a bending machine, the lower rolls being parallel to each other and relative to the upper roll; moving the plate by rotation of the lower rolls while supporting it with the upper and lower rolls; and forming a pipe by bending the plate under pressure of the upper and lower rolls, wherein this forming comprises a rough forming step in which the plate is formed into a pipe having a rough radius, and a fine forming step following the rough forming step for finishing the pipe to a required radius. In the rough forming step, the plate is bent by pressing it with the upper and lower rolls so that a required radius will be obtained at a hole portion, and in the fine forming step, no bending action is applied to the hole portion and the plate is rolled by pressing it with the upper and lower rolls so that at a portion other than the hole portion, a radius will coincide with that at the hole portion.

According to this invention, there is also provided a device for forming a pipe comprising an upper roll and a pair of lower rolls which are parallel to each other and are arranged so as to vertically oppose each other. One of the upper and lower rolls is provided so as to be movable vertically and horizontally relative to the others. Actuators are provided for rotating, raising and lowering the rolls so as to move the rolls while supporting a plate with holes which is supplied between the upper and lower rolls by rotation of the rolls, and simultaneously bend the plate under pressure of the rolls to form a pipe. Also provided is a control unit for controlling the actuators, the control including a control program for controlling a pipe forming step comprising a rough forming step in which the plate is formed into a rough radius, and a fine forming step following the rough forming step for finishing the plate to a required radius. In the rough forming step, the plate is bent by pressing it with the upper and lower rolls so that a required diameter will be obtained at hole portions, and in the fine forming step, no bending action is applied to the hole portions, and the plate is rolled by pressing it with the upper and lower rolls so that at portions other than the hole portions, the pipe radius coincides with that of the hole portions.

With this method and device for forming a pipe, simply by operating a bending machine, without using any other auxiliary measures or without needing troublesome auxiliary work, a finished product of a pipe can be formed by bending. In a method in which a pipe is formed by bending a plate having holes, influences of pressing are different between hole portions and other portions. Thus, in a rough forming step, bending is performed such that a radius near the hole portions will be a required radius, which is a radius of a pipe of the finished product. A radius of portions other than the hole portions is slightly larger than the required radius.

Thus, in a fine forming step, rolling is performed on portions other than the hole portions to apply bending so that a required diameter is obtained. Since the hole portions are already worked to a required radius, by feeding the plate with the upper roll separated from the plate, or supporting it with the upper and lower rolls so that a bending action is not applied, and thereafter by lowering the upper roller and continuing rolling, a radius of the portions other than the hole portions approaches the required radius, so that a pipe of a finished product is obtained.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
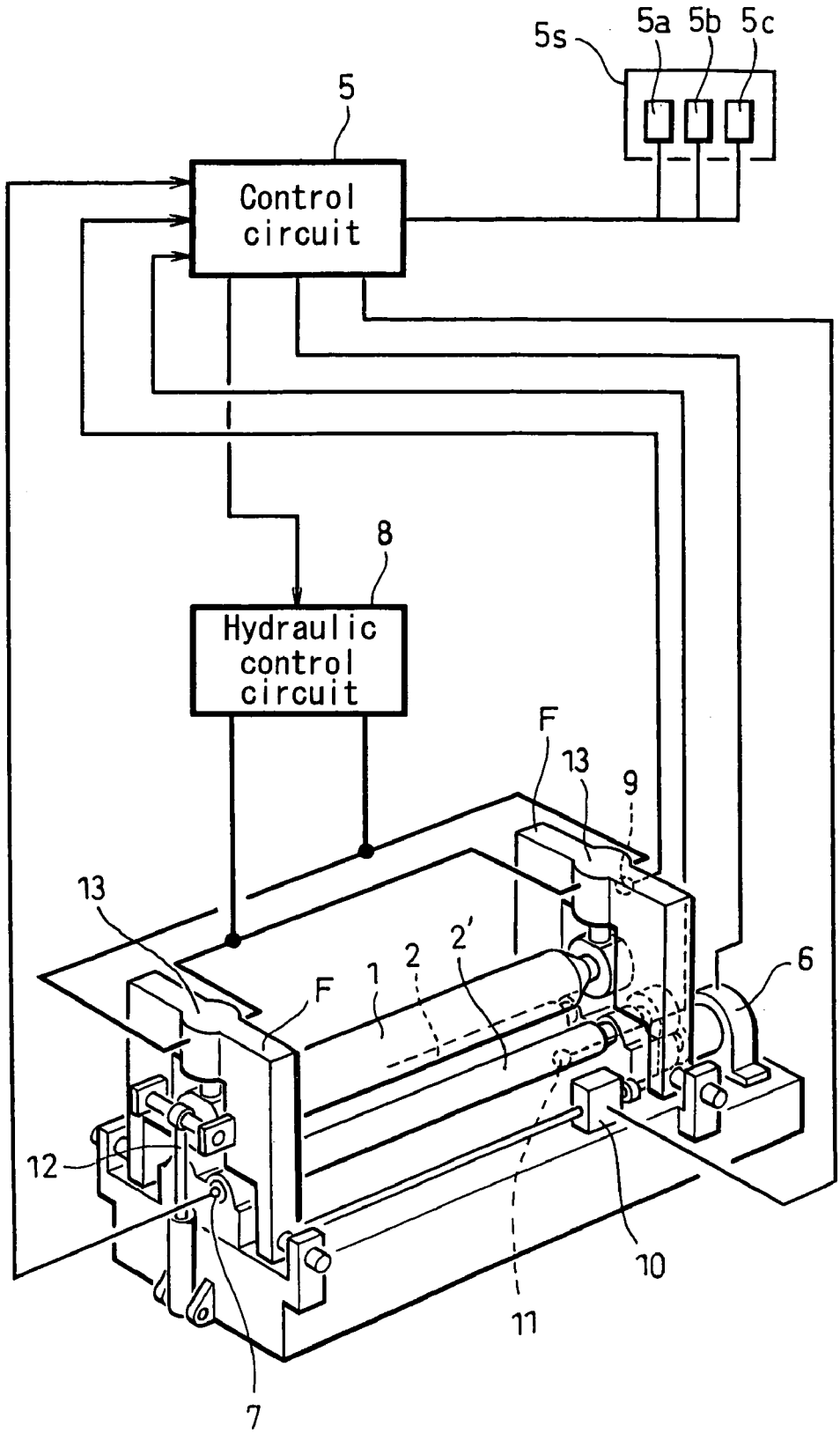
FIG. 1 is a block diagram of a control line with a perspective view of a bending machine embodying the present invention.

An embodiment of this invention will be described with reference to the drawings. FIG. 1 shows a perspective view of a bending machine of an embodiment with a block diagram of a control circuit for controlling driving units (or actuators). This bending machine has an upper roll 1 arranged between opposed frames F, and two lower rolls 2 and 2' provided below the upper roll 1 so as to be parallel to each other and relative to the upper roll 1. The upper roll 1 is provided so as to be moved up and down by a hydraulic cylinder 13 and to be movable back and forth by a motor 10.

The lower rolls 2 and 2' are rotated in normal and reverse directions by a motor 6. While backup rolls and 2' are provided below the lower rolls 2, they are omitted for simplicity. A hydraulic cylinder 12 is provided to outwardly incline each frame F. In this embodiment, as the actuators, the motors 6, 10 and the hydraulic cylinders 12, 13 are provided.

Operation of the bending machine is controlled by a control circuit 5. The control circuit comprises a sequencer for performing control based on signals from a numerical setter 5*s*. A numerical setter 5*a* is for setting rotating amounts Z (Z1, Z2, . . . ) of the lower rolls 2, 2', which are converted to moving amounts of a plate W. A numerical setter 5*b* is for setting vertical movement amounts Y (Y1, Y2, . . . ) of the upper roll 1, and a numerical setter 5*c* is for setting horizontal movement amount X of the upper roll 1.

For these set values Z, Y and X, values set at the numerical setters 5*a*–5*c* based on bending parameters such as a yield point of material, plate thickness, plate width, radius of curvature R and a size and position of holes are input into the control circuit 5 beforehand. Numbers of revolutions of the lower rollers 2 and 2' are detected by signals from rotation sensors 7 and are converted to distance L in the control circuit 5.

Vertical movement of the upper roll 1 is performed by feeding hydraulic pressure to the hydraulic cylinder 13 by a hydraulic pressure control circuit 8. Amounts of its vertical movement are detected by a position detector 9 mounted on a side frame F. Horizontal movement of the upper roll 1 is detected by a position detector 11 mounted on a lower frame. Operations of the motors 6 and 10, and the hydraulic cylinders 13 and 12, are controlled based on commands from the control circuit 5. Detected values of the position detectors 9 and 11, and the rotation sensors 7 are input to the control circuit 5.

A method of forming a pipe by bending a plate by using this bending machine will be described below with reference to FIGS. 2A and 2B and the flowcharts of FIGS. 3A–3E. When a start button of the bending machine is pressed, the control circuit will begin control based on signals from an input device, selected beforehand from among control modes by an operator. In this control action, operational conditions at a start are checked, and if there should be any abnormality, "abnormal message" is displayed.

Figure 2A:
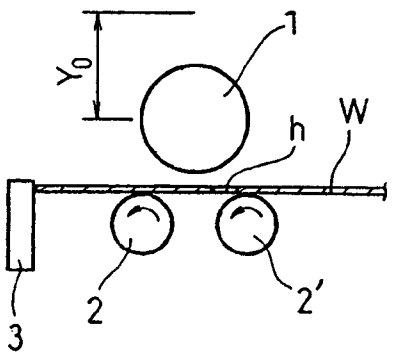
FIGS. 2A(a)–2A(f) are views for explaining a rough pipe forming step.
Figure 2A:
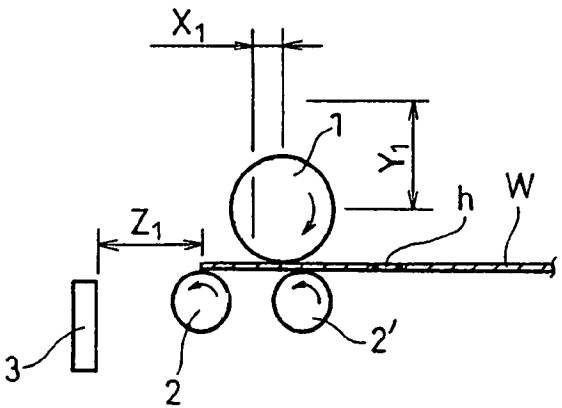
Figure 2A:
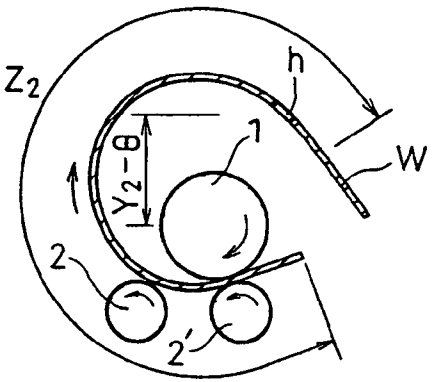
Figure 2A:
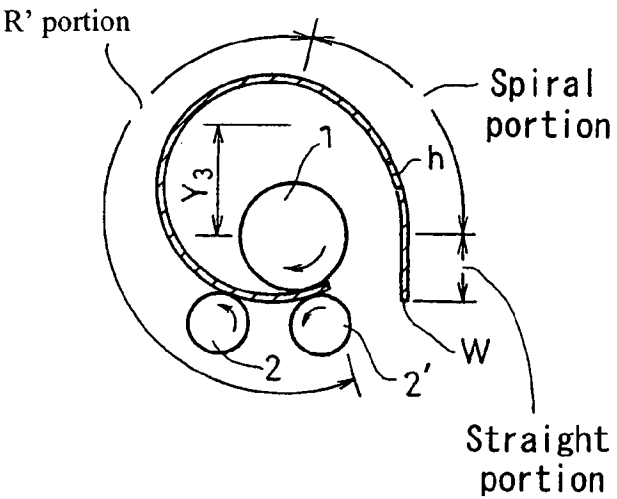
Figure 2A:
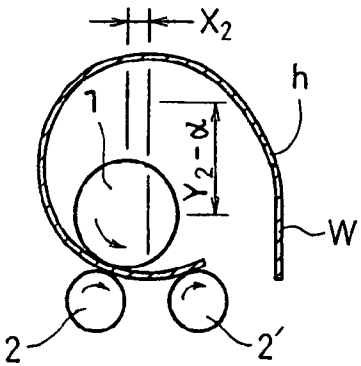
Figure 2A:
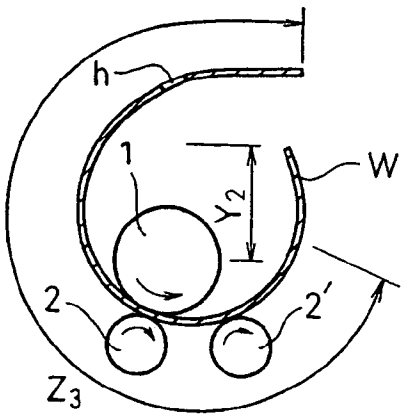

If there is no abnormality, it is determined that preparation for working has been completed, and actions shown in FIG. 2A and subsequent figures will begin. First in step S1 of FIG. 3A, backup rolls (not shown) are moved up or down, and in step S2 it is judged whether the backup rolls are at predetermined position H1. After a stopper 3 for the plate W (steel plate) has been raised in step S3, as shown in FIG. 2A(a), the plate W is fed from rear lower roll 2' toward front lower roll 2 between the upper roll 1 and the lower rolls 2, 2', and the plate W is held with its front end abutting the stopper 3, which is arranged so as to be parallel to the lower rolls 2 and 2'. Also, before the start of operation, the upper roll 1 is at a standby position Y0 which is above the lower rolls 2, 2'.

In response to a plate feed end signal, the upper roll 1 is lowered to position YL (not shown) in step S5. In step S7, the upper roll 1 is moved from standby position X0 to position X1 toward the rear lower roll 2'. In step S9, the upper roll 1 is lowered to set position Y1 to clamp the plate W (see FIG. 2A(b)). In step S11, the lower rolls 2, 2' are driven to move the plate W so that the front end of the plate W will come to a position right over the front lower roll 2 and spaced a distance Z1 from the stopper 3 (FIG. 2A(b)). Values X1, YL, Y1, Z1 are values calculated according to a bending mode beforehand and stored in the control circuit 5. The process automatically proceeds to a next operation after the plate arrives at the set position.

Below-described Y2, Y3 . . . , Z2, Z3 . . . etc. are also values calculated and set according to the bending mode. In the state of FIG. 2A(b), the upper roll 1 is still set at position Y1 where the plate W is retained in a horizontal state. In this position, no bending action is performed on the plate W. This completes setting of the plate W to a forming start position. After lowering the stopper 3 in step S13, the lower rolls 2, 2' are driven in step S14 to move the plate W forward to start forming the plate and to feed the plate to set position Z2. Simultaneously with start of this formation, as shown in FIG. 2A(c), in step S16, the upper roll 1 is lowered to set position Y2-θ. The plate is subjected to bending under a pressing force applied by the upper roll.

Driving of the lower rolls 2, 2' and lowering of the upper roll 1 are started substantially simultaneously. Y2 is a value necessary for keeping the upper roll 1 at a set position as shown in FIG. 2A(f). In the state of FIG. 2A(c), the upper roll 1 is set at set position Y2-θ which is just before the set position Y2.

While the plate W is being fed to set position Z2 in step S15, it takes time for the upper roll 1 to lower to set position Y2-θ. Bending during this time is in a spiral form because a position of the upper roll 1 changes little by little. By further bending the plate W after the upper roll 1 has lowered to set position Y2-θ, an R' portion is formed with radius R'. But a portion of a predetermined short length from the front end of the plate W is left unworked. Thus, in step S18, as shown in FIG. 2A(d), the upper roll 1 is lowered to set position Y3 (in step S19) to perform press end bending. Bending up to the length Z2 thus ends.

Next, an entire circumferential length of the plate W is formed into a pipe of a desired radius R (R>R') by reversing a feed direction of the plate W as shown in FIG. 2A(e). First, from the state of FIG. 2A(d), in step S22, while raising the upper roll 1 to set position Y2-α, the lower rolls 2, 2' are driven in step S20 in a direction opposite to set position γ. This is done to stabilize the plate W on the lower rolls 2, 2' while the upper roll 1 is being moved to set position X2 in below-described step S24.

Figure 3A:
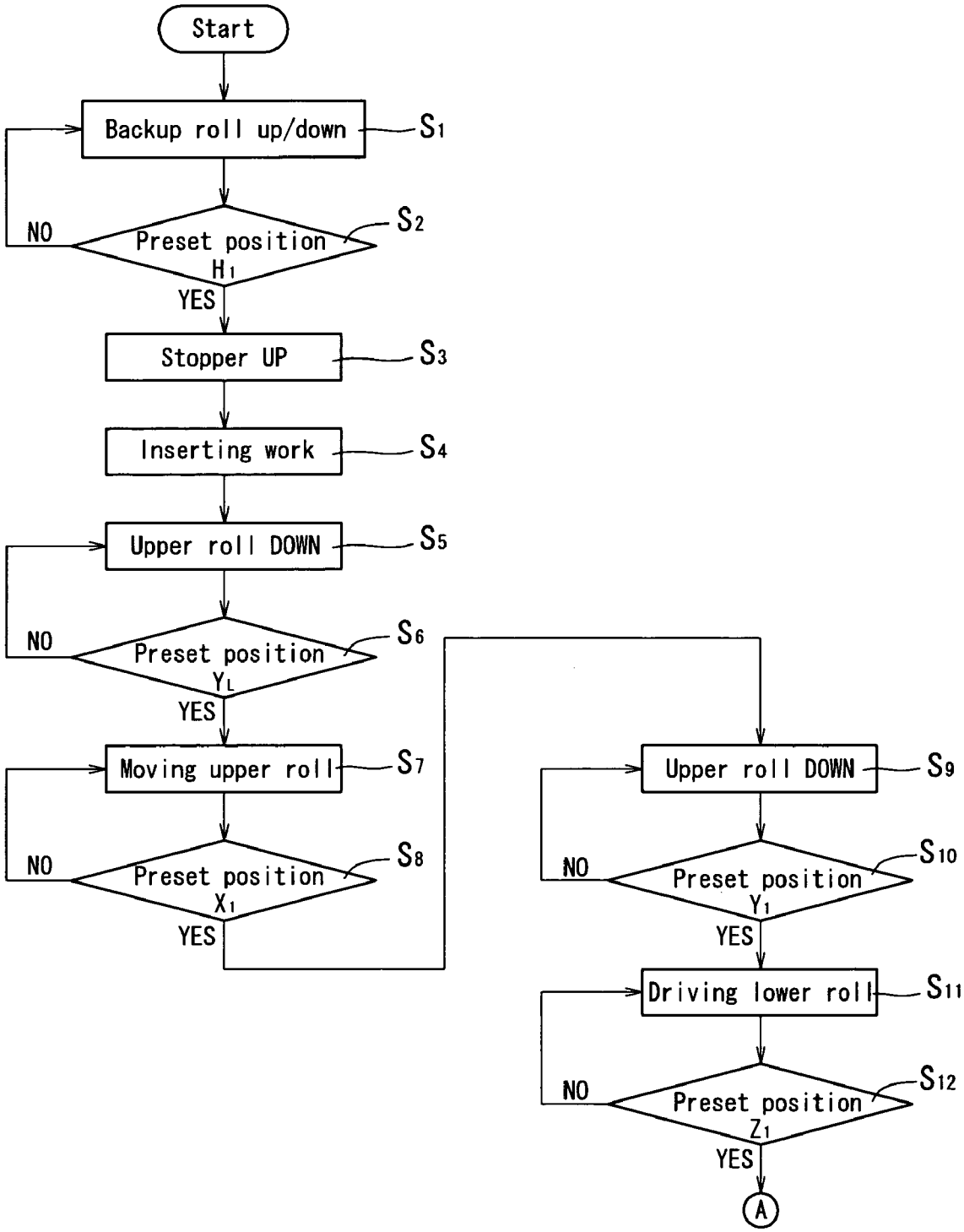
FIGS. 3A, 3B and 3C are flowcharts of the rough pipe forming step.
Figure 3B:
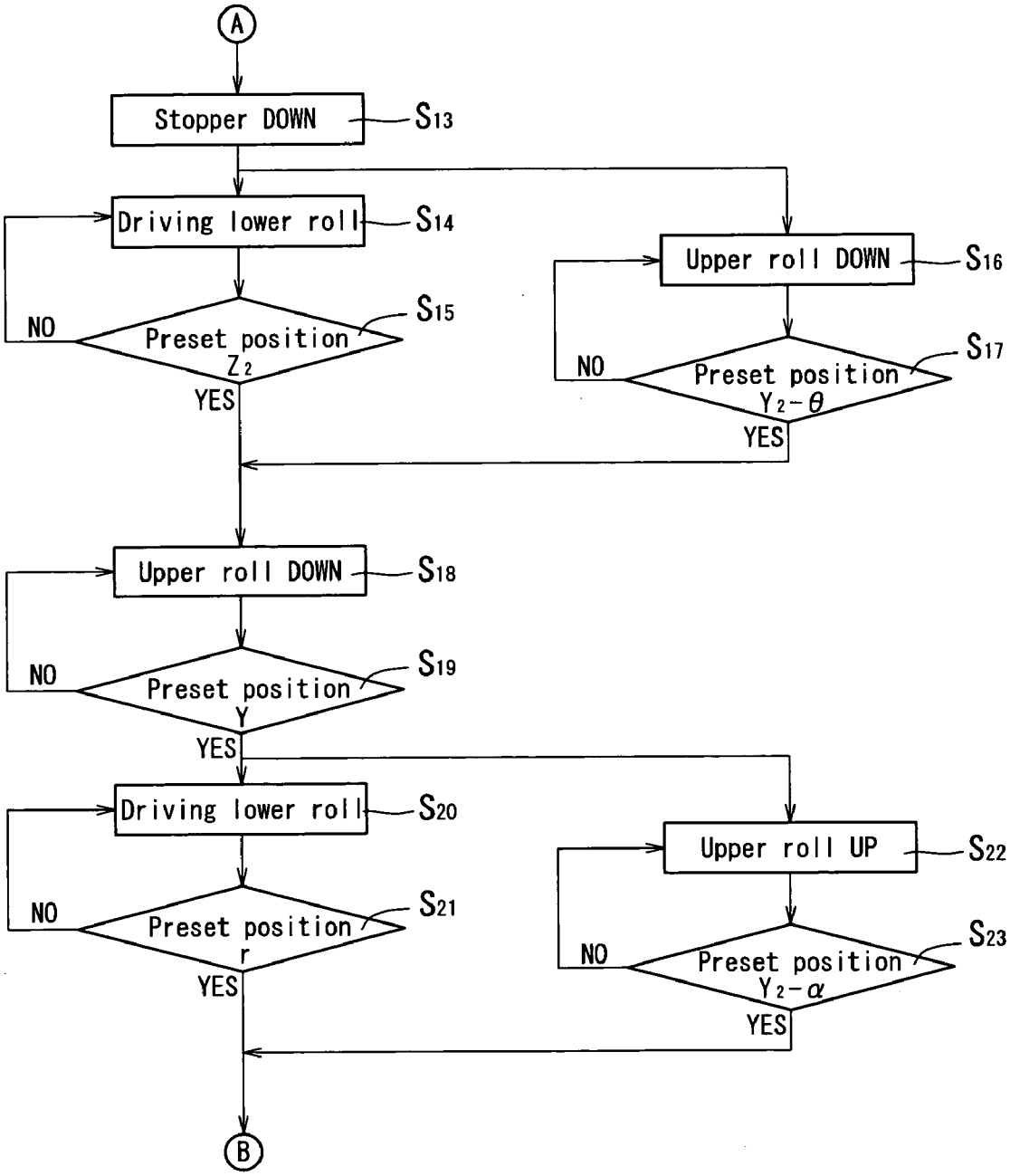
Figure 3C:
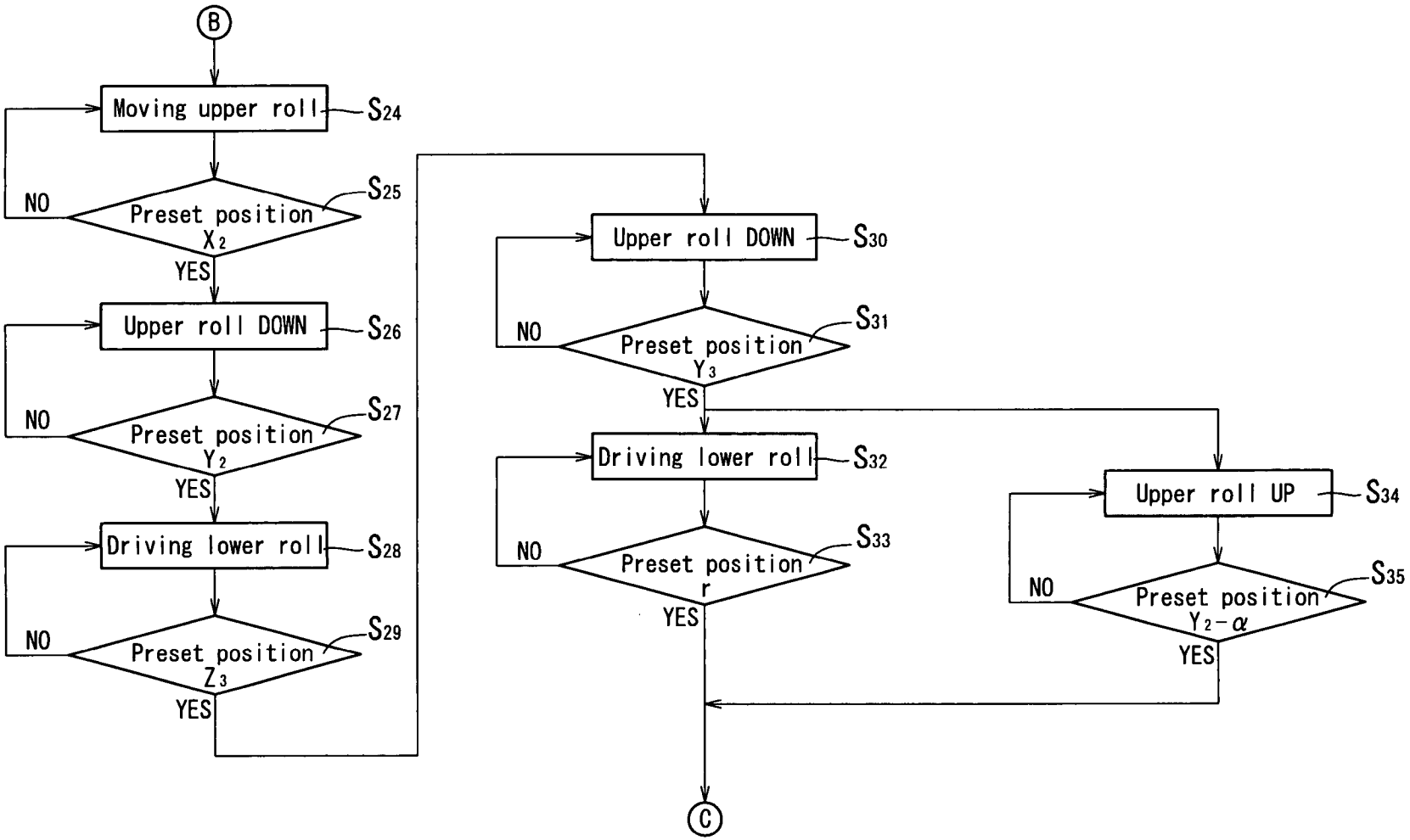
Figure 3D:
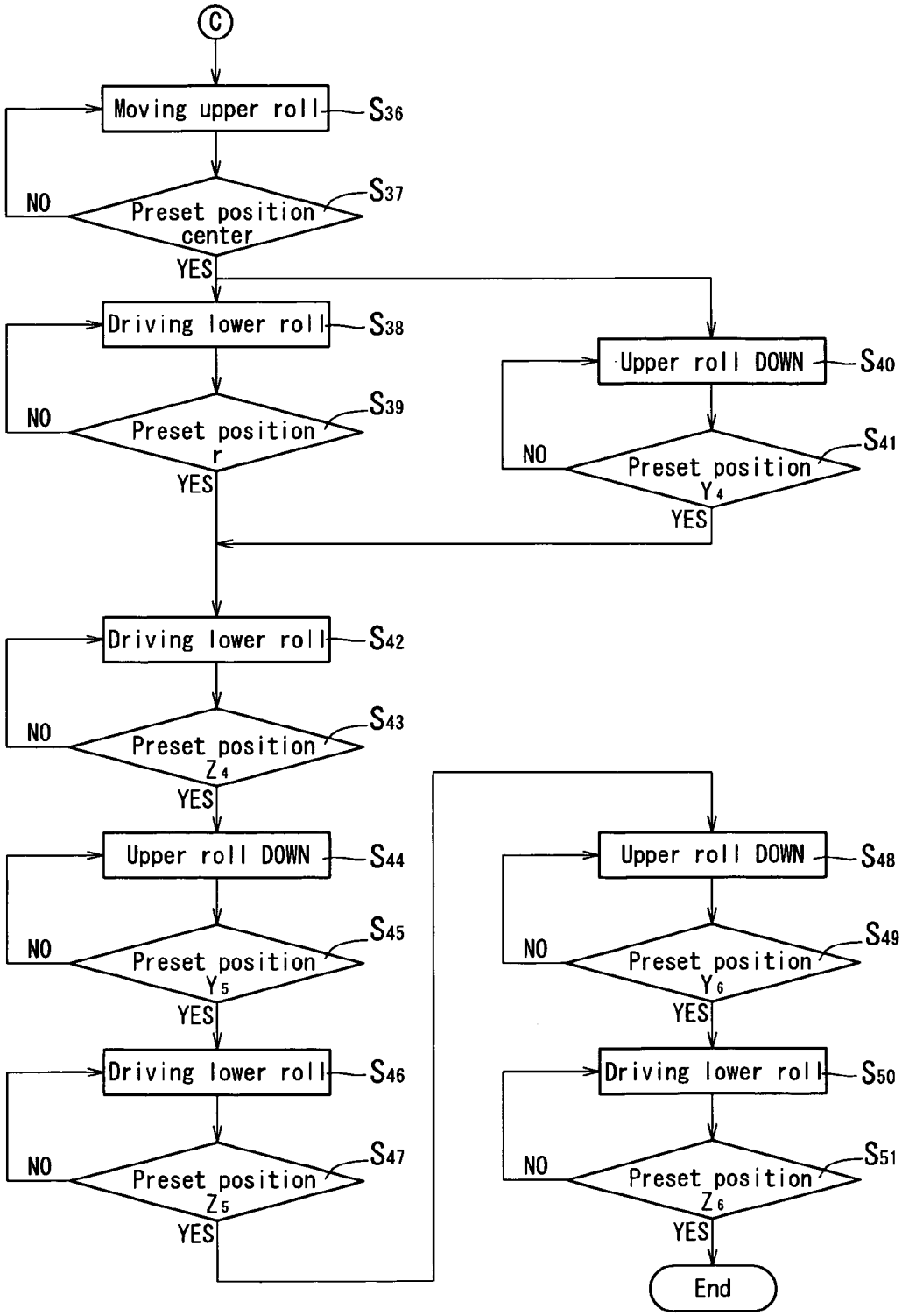
FIGS. 3D and 3E are flowcharts of the fine pipe forming step.

After raising the upper roll 1 to set position Y2-α, in step S24 shown in FIG. 3C, the upper roll 1 is moved in an opposite direction to set it in set position X2 as shown in FIG. 2A(e). After setting the upper roll 1 in the above position, the upper roll 1 is lowered in step S26 to set position Y2, and the lower rolls 2, 2' are again driven in step S28 in the opposite direction to feed the plate to set position Z3 (in step S29).

When the radius R' portion, spiral portion and straight portion pass, bending to a desired radius R is performed by the upper roll 1 which is set at position Y2, and the lower rolls 2, 2'. Further, in the same manner as in step S18, press end bending is performed for a portion of a predetermined short length from an opposite end by lowering the upper roll 1 to set position Y3 in step S30. Thus, as shown in FIG. 2B(g), a pipe of desired radius R is formed over an entire circumference of the plate.

Figure 4A:
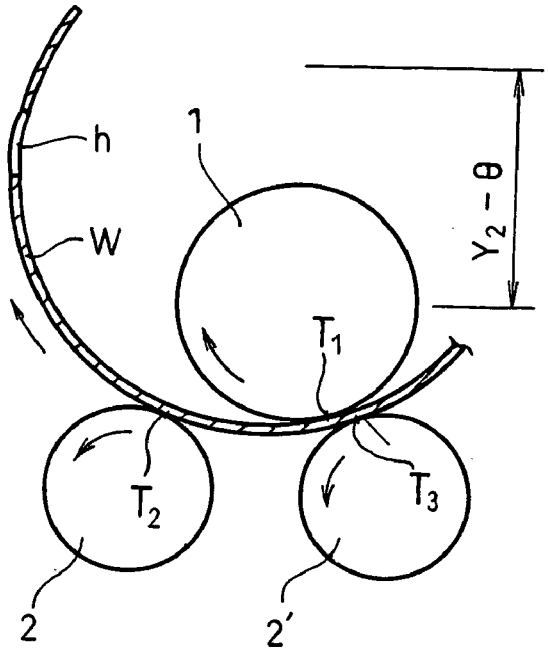
FIGS. 4A–4C are explanatory views of the fine pipe forming step.
Figure 4B:
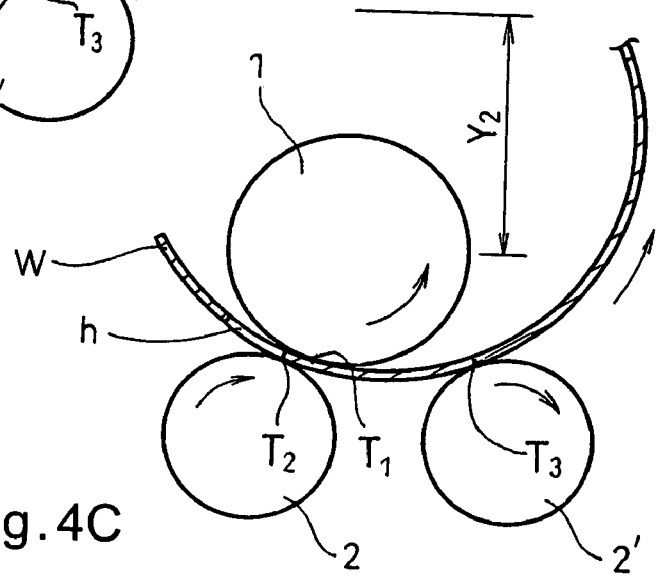
Figure 4C:
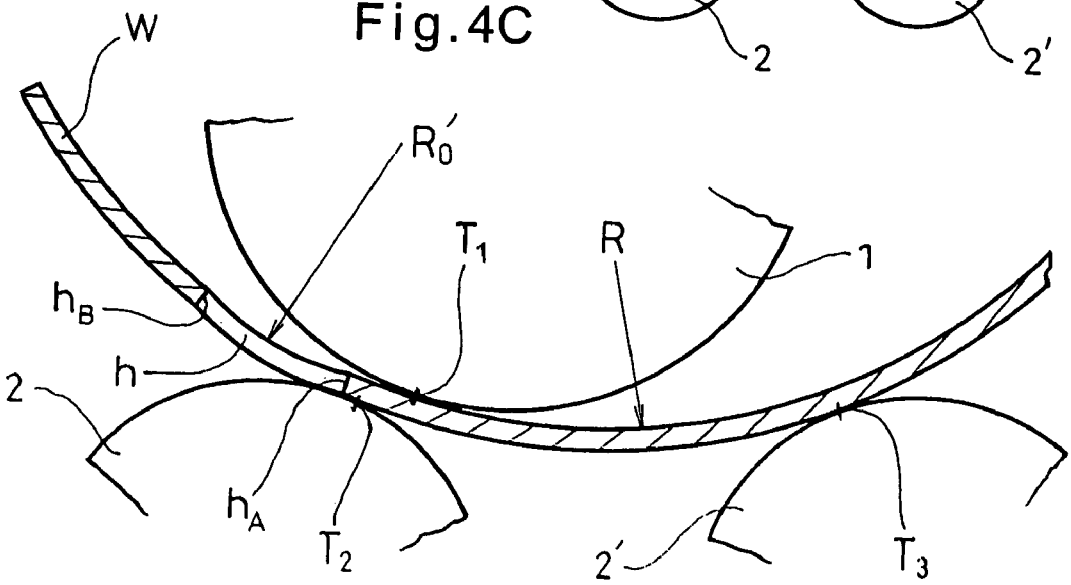

This is a rough forming step performed by bending the plate W. This bending of the plate W is working to a desired radius R. The radius R is slightly larger than radius R0 of a pipe as a finished product to be ultimately obtained (R0<R). A reason for this is that as shown in FIGS. 4A–4C, at portions near holes h of the plate W, influence of bending is stronger than at portions other than the portions near the holes, so that a radius will be smaller than at other portions and thus a pipe having a uniform radius will not result. Thus, work is performed such that only portions at the holes h will have the radius R0 of the finished product.

In FIGS. 2A(c) and 2A(f), which show a rough forming step, a reason why a vertical position of the upper roll 1 is set at (Y2-θ) and Y2 is as follows. As shown in FIG. 4A, while bending the plate W during rolling in a going path, as described above, the straight portion, spiral portion and radius R' portion are formed with the upper roll 1 set at Y2-θ, so that the radius of the portions near the holes will be R0' which is smaller than at other portions. As shown in FIG. 4B, bending is performed with a position of the upper roll 1 set at Y2 during rolling in a return path so that the radius at the hole portions will be the radius R0 of the finished product.

During rolling in the going and return paths, contact points between the upper roll 1 and the lower rolls 2, 2' are T1, T2 and T3. A manner by which the plate W contacts the upper and lower rolls 1, 2, 2' remains unchanged until the plate W reaches the state of FIG. 4B. But when the plate W further moves in the direction of the arrow beyond the state of FIG. 4B, since the radius R0' at the hole portions h is different from the radius at the other portions, the manner by which the plate contacts the rolls at T2 and T1 changes, so that slippage occurs between the plate W and the upper roll 1.

In order to eliminate such slippage, a position of the upper roll 1 in the going path is set at Y2-θ, which is slightly above the position Y2 in the return path, so that pressure exerted by the upper roll 1 will be greater in the return path than in the going path, thereby smoothly rolling while preventing slippage. Thus, by setting the position of the upper roll 1 at Y2 for the rolling in the return path, the bending radius Rθ' of the portions at hole h in the going path will be pipe radius Rθ of the finished product, and other portions will have a radius R which is slightly greater than Rθ.

Figure 2B:
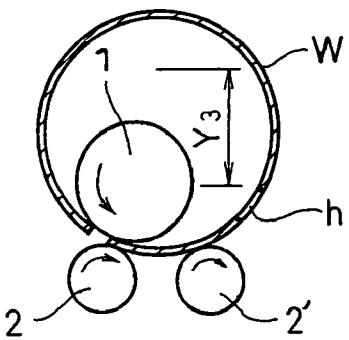
FIGS. 2B(g)–2B(l) are views for explaining a fine pipe forming step.
Figure 2B:
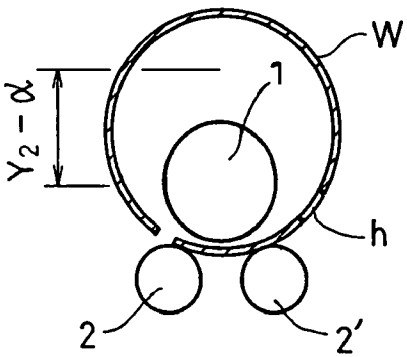
Figure 2B:
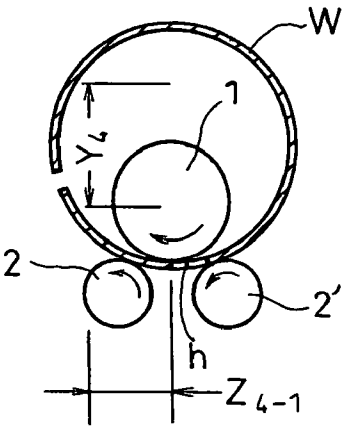
Figure 2B:
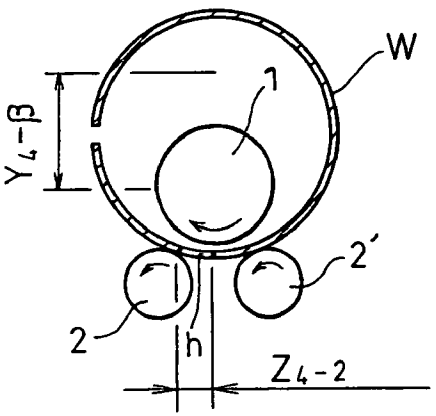
Figure 2B:
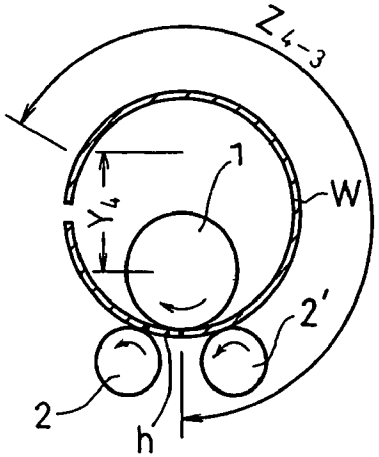
Figure 2B:
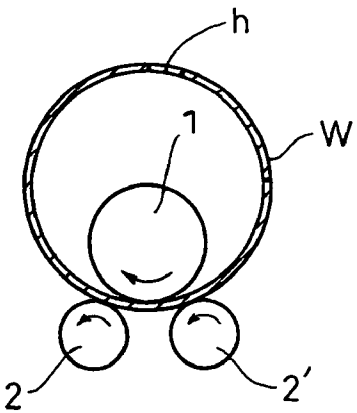

After the rough forming, as shown in FIG. 2B(h), the upper roll 1 is returned to the set position Y2-α and to a central position between the lower rolls 2, 2'. At this position, no load is applied to the plate W. In order to return the plate to this set position, the upper roll 1 is raised in step S34 to set position Y2-α, and the lower rolls 2, 2' are slightly driven in step S32 to feed them to set position γ so that the plate W will be in a stable state on the lower rolls 2, 2'. And in step S36 in FIG. 3D, the upper roll 1 is returned to the central position.

Next, in a fine forming step shown in FIG. 2B(i) and subsequent figures, bending is performed so that the plate will have the radius R0 as the pipe of the finished product. In step S38, the lower rolls 2, 2' are driven to return the plate W to a predetermined position, and in step S40, the upper roll 1 is lowered to set position Y4. At this time, steps S40, S41 and steps S38, S39 are parallelly performed. Thereafter in step S42, the lower rolls 2, 2' are driven to feed the plate W to set position Z4 (Z4-1+Z4-2+Z4-3), and bending in a first fine forming step is performed. Thereafter, in the same manner, lowering of the upper roll 1 and feeding of the plate W by virtue of the lower rolls 2, 2' are repeated three times to move the plate to Y5 in step S44, to Z5 in step S46, to Y6 in step S48 and to Z6 in step S50.

Figure 3E:
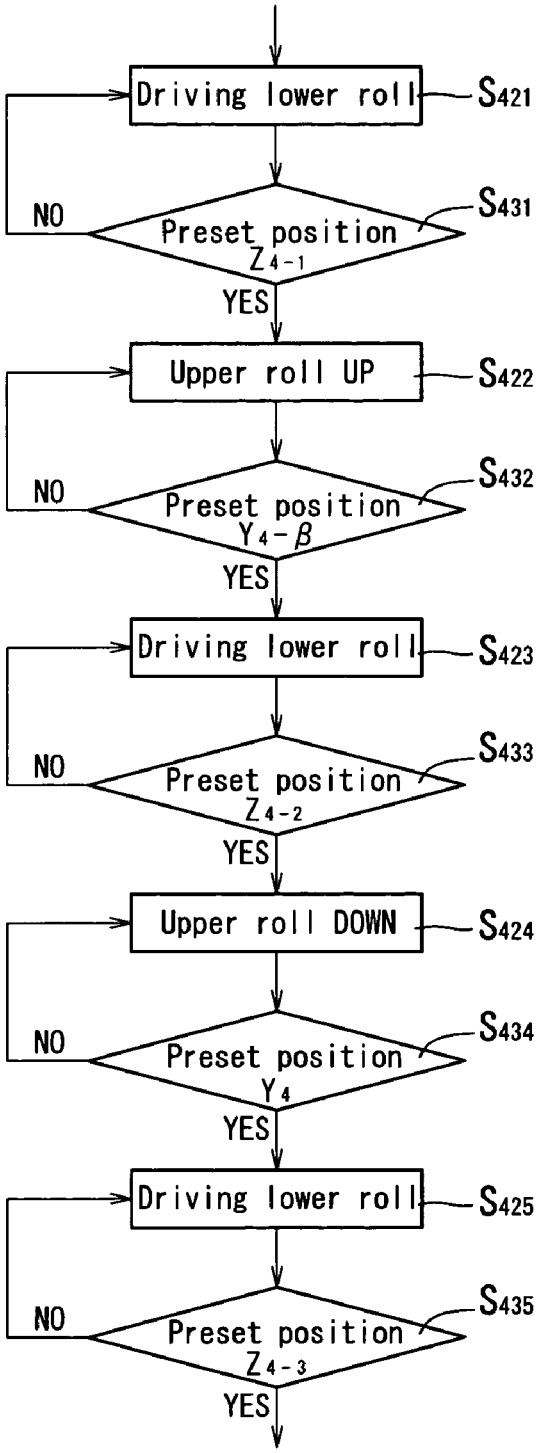

Details about feed to set positions Y4, Y5 and Y6 and set positions Z4, Z5 and Z6 are shown in FIG. 2B(i) and the flowchart of FIG. 3E. In step S421, the lower rolls 2, 2' are driven to feed the plate W to set position Z4-1. As shown in FIG. 2B(i), this position is a position just before the upper roll 1 reaches the holes h. At this set position, as shown in FIG. 2B(j), the upper roll 1 is raised in step S422 to set position Y4-β, the lower rolls 2, 2' are driven in step S423 to feed the plate W to set position Z4-2. After passing the holes h, the upper roll 1 is lowered again to set it at position Y4. Thereafter, in step S425, the lower rolls 2, 2' are driven to feed the plate W to Z4-3 to perform bending over an entire circumference. After performing the first fine forming in this manner, the plate W is turned in an opposite direction to perform a second fine forming with the upper roll 1 set at position Y5. Next, the plate W is reversed to perform a third fine forming with the upper roll 1 set at position Y6.

While an example in which the fine forming is performed three times has been described, a number of fine formings may be more than or less than three. In any fine forming, the upper roll 1 is raised a little not to perform bending near the holes h, and at any other portion the upper roll 1 is lowered little by little as the number of fine formings increases, to obtain the pipe radius R0 for the finished product. Also, a set position for fine forming and a number of risings and lowerings at the hole portions may be changed according to a number of holes.

Figure 5:
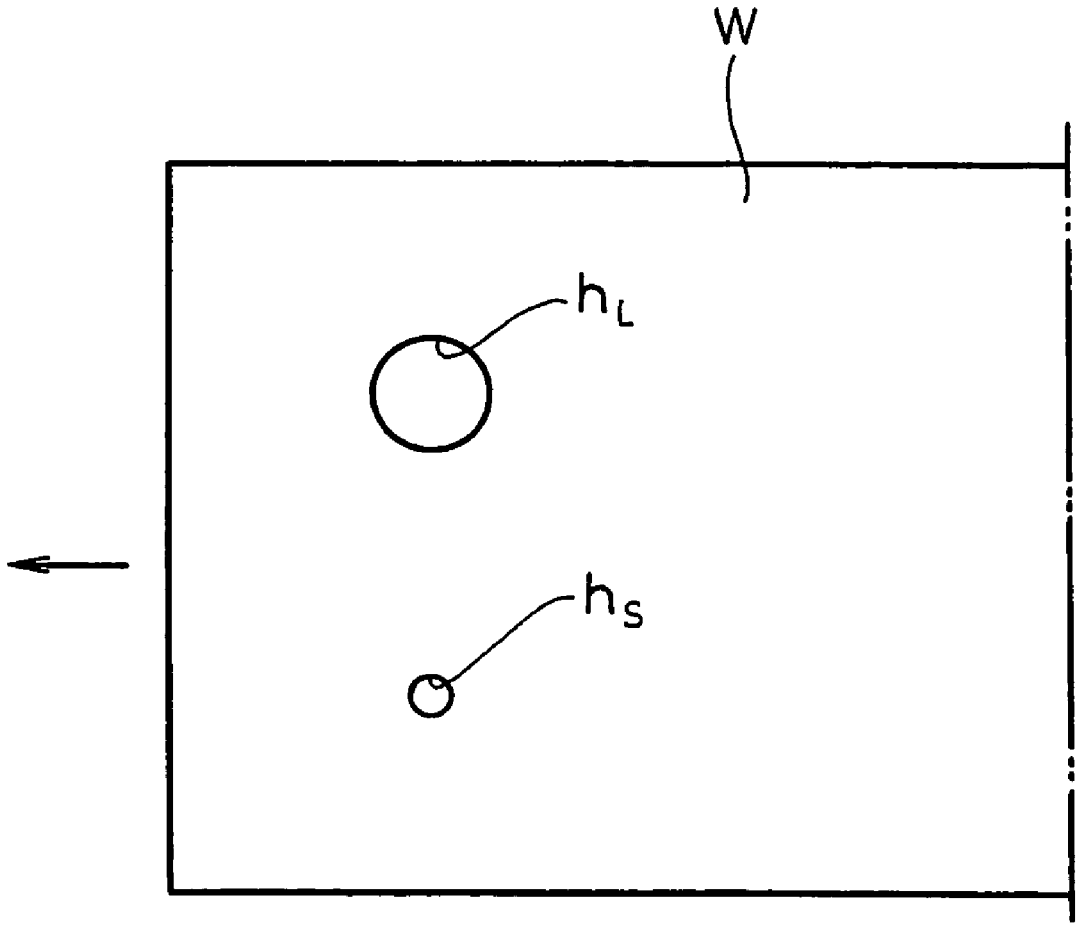
FIG. 5 is a view showing holes of a plate.

As shown in FIG. 5, if the plate W has holes hL and hS having different diameters, handling should be made so that the hole HL, which is larger in diameter, corresponds to the above-described hole h because influence of the hole hS, which is smaller in diameter, is smaller than that of the larger-diameter hole hL.

As described above in detail, in a method and device for forming a pipe by bending a plate having holes according to this invention, in a rough forming step, hole portions are formed to a required radius while other portions are formed to a slightly larger radius. In a fine forming step, pressing for bending is not performed at the hole portions while the other portions are brought to a required radius by rolling little by little. Thus, simply by operating a bending machine, the plate can be finished to a finished product without need of correcting work using other auxiliary devices. Thus, a pipe can be formed accurately and efficiently by use of only a bending machine without troublesome work.

What is claimed is:

1. A method of forming a pipe, comprising:

feeding a workpiece, having a hole therein, between an upper roll and two lower rolls of a bending machine, with said two lower rolls being parallel to each other and parallel to said upper roll;

moving said workpiece by rotating said two lower rolls while supporting said workpiece with said upper roll and said two lower rolls;

bending said workpiece under pressure of said upper roll and said two lower rolls such that said workpiece is formed into a pipe member having a required radius at a portion where said hole is located; and then pressing said pipe member with said upper roll and said two lower rolls such that no bending action is applied to said portion where said hole is located, and such that said pipe member is rolled whereby other portions of said pipe member are made to have a radius coinciding with the radius at said portion where said hole is located.

2. The method according to claim 1, wherein when said workpiece has a hole having a larger diameter and a hole having a smaller diameter, a portion of said workpiece at said hole having said larger diameter corresponds to said portion where said hole is located, and a portion of said workpiece at said hole having said smaller diameter corresponds to one of said other portions.

3. The method according to claim 2, wherein pressing said pipe member with said upper roll and said two lower rolls such that no bending action is applied to said portion where said hole is located, and such that said pipe member is rolled whereby other portions of said pipe member are made to have a radius coinciding with the radius at said portion where said hole is located, comprises feeding said pipe member in plural passes between said upper roll and said two lower rolls, with each of said passes corresponding to a step-wise reduction of a distance between said upper roll and said two lower rolls.

4. The method according to claim 3, wherein bending said workpiece under pressure of said upper roll and said two lower rolls such that said workpiece is formed into a pipe member having a required radius at a portion where said hole is located comprises (i) with said upper roll shifted to one side from a central position between said two lower rolls and while feeding said workpiece in a going path, rolling said workpiece by pressing said workpiece between said upper roll and said two lower rolls, and bending one end of said workpiece by pressing said one end between said upper roll and said two lower rolls, and then (ii) with said upper roll shifted to another side from said central position between said two lower rolls and while feeding said workpiece in a return path, rolling said workpiece by pressing said workpiece between said upper roll and said two lower rolls, and bending another end of said workpiece by pressing said another end between said upper roll and said two lower rolls.

5. The method according to claim 2, wherein bending said workpiece under pressure of said upper roll and said two lower rolls such that said workpiece is formed into a pipe member having a required radius at a portion where said hole is located comprises (i) with said upper roll shifted to one side from a central position between said two lower rolls and while feeding said workpiece in a going path, rolling said workpiece by pressing said workpiece between said upper roll and said two lower rolls, and bending one end of said workpiece by pressing said one end between said upper roll and said two lower rolls, and then (ii) with said upper roll shifted to another side from said central position between said two lower rolls and while feeding said workpiece in a return path, rolling said workpiece by pressing said workpiece between said upper roll and said two lower rolls, and bending another end of said workpiece by pressing said another end between said upper roll and said two lower rolls.

6. The method according to claim 1, wherein bending said workpiece under pressure of said upper roll and said two lower rolls such that said workpiece is formed into a pipe member having a required radius at a portion where said hole is located comprises (i) with said upper roll shifted to one side from a central position between said two lower rolls and while feeding said workpiece in a going path, rolling said workpiece by pressing said workpiece between said upper roll and said two lower rolls, and bending one end of said workpiece by pressing said one end between said upper roll and said two lower rolls, and then (ii) with said upper roll shifted to another side from said central position between said two lower rolls and while feeding said workpiece in a return path, rolling said workpiece by pressing said workpiece between said upper roll and said two lower rolls, and bending another end of said workpiece by pressing said another end between said upper roll and said two lower rolls.

7. The method according to claim 6, wherein pressing said pipe member with said upper roll and said two lower rolls such that no bending action is applied to said portion where said hole is located, and such that said pipe member is rolled whereby other portions of said pipe member are made to have a radius coinciding with the radius at said portion where said hole is located, comprises feeding said pipe member in plural passes between said upper roll and said two lower rolls, with each of said passes corresponding to a step-wise reduction of a distance between said upper roll and said two lower rolls.

8. The method according to claim 7, wherein (i) with said upper roll shifted to one side from a central position between said two lower rolls and while feeding said workpiece in a going path, (a) rolling said workpiece by pressing said workpiece between said upper roll and said two lower rolls comprises pressing said workpiece between said upper roll and said two lower rolls with said upper roll and two lower rolls being spaced by a first distance, and (b) bending one end of said workpiece by pressing said one end between said upper roll and said two lower rolls comprises pressing said workpiece between said upper roll and said two lower rolls with said upper roll and two lower rolls being spaced by a second distance which is less than said first distance, and (ii) with said upper roll shifted to another side from said central position between said two lower rolls and while feeding said workpiece in a return path, (a) rolling said workpiece by pressing said workpiece between said upper roll and said two lower rolls comprises pressing said workpiece between said upper roll and said two lower rolls with said upper roll and two lower rolls being spaced by said first distance, and (b) bending another end of said workpiece by pressing said another end between said upper roll and said two lower rolls comprises pressing said workpiece between said upper roll and said two lower rolls with said upper roll and two lower rolls being spaced by said second distance.

9. The method according to claim 6, wherein (i) with said upper roll shifted to one side from a central position between said two lower rolls and while feeding said workpiece in a going path, (a) rolling said workpiece by pressing said workpiece between said upper roll and said two lower rolls comprises pressing said workpiece between said upper roll and said two lower rolls with said upper roll and two lower rolls being spaced by a first distance, and (b) bending one end of said workpiece by pressing said one end between said upper roll and said two lower rolls comprises pressing said workpiece between said upper roll and said two lower rolls with said upper roll and two lower rolls being spaced by a second distance which is less than said first distance, and (ii) with said upper roll shifted to another side from said central position between said two lower rolls and while feeding said workpiece in a return path, (a) rolling said workpiece by pressing said workpiece between said upper roll and said two lower rolls comprises pressing said workpiece between said upper roll and said two lower rolls with said upper roll and two lower rolls being spaced by said first distance, and (b) bending another end of said workpiece by pressing said another end between said upper roll and said two lower rolls comprises pressing said workpiece between said upper roll and said two lower rolls with said upper roll and two lower rolls being spaced by said second distance.

10. The method according to claim 1, wherein pressing said pipe member with said upper roll and said two lower rolls such that no bending action is applied to said portion where said hole is located, and such that said pipe member is rolled whereby other portions of said pipe member are made to have a radius coinciding with the radius at said portion where said hole is located, comprises feeding said pipe member in plural passes between said upper roll and said two lower rolls, with each of said passes corresponding to a step-wise reduction of a distance between said upper roll and said two lower rolls.

11. An apparatus for forming a pipe, comprising:

an upper roll, and two lower rolls which are parallel to each other and parallel to said upper roll so as to be vertically opposed said upper roll;

first actuators for rotating said upper roll and said two lower rolls;

a second actuator for raising and lowering said upper roll or said two lower rolls;

a third actuator for horizontally moving said upper roll or said two lower rolls; and a control unit for controlling said first, second and third actuators based on a position of a hole in a workpiece such that the workpiece is to be formed into a pipe by (i) feeding the workpiece between said upper roll and said two lower rolls, (ii) moving the workpiece by rotating said two lower rolls while supporting the workpiece with said upper roll and said two lower rolls;

(iii) bending the workpiece under pressure of said upper roll and said two lower rolls such that the workpiece is formed into a pipe member having a required radius at a portion where the hole is located; and then (iv) pressing the pipe member with said upper roll and said two lower rolls such that no bending action is applied to the portion where the hole is located, and such that the pipe member is rolled whereby other portions of the pipe member are made to have a radius coinciding with the radius at the portion where the hole is located.

12. The apparatus according to claim 11, wherein when the workpiece has a hole having a larger diameter and a hole having a smaller diameter, said control unit is for controlling said first, second and third actuators based on a position of the hole having the larger diameter such that a portion of the workpiece at the hole having the larger diameter corresponds to the portion where the hole is located, and a portion of the workpiece at the hole having the smaller diameter corresponds to one of the other portions.

13. The apparatus according to claim 12, wherein said control unit is for controlling said first, second and third actuators such that pressing the pipe member with said upper roll and said two lower rolls such that no bending action is applied to the portion where the hole is located, and such that the pipe member is rolled whereby other portions of the pipe member are made to have a radius coinciding with the radius at the portion where the hole is located, comprises feeding the pipe member in plural passes between said upper roll and said two lower rolls, with each of the passes corresponding to a step-wise reduction of a distance between said upper roll and said two lower rolls.

14. The apparatus according to claim 13, wherein said control unit is for controlling said first, second and third actuators such that bending the workpiece under pressure of said upper roll and said two lower rolls such that the workpiece is formed into a pipe member having a required radius at a portion where the hole is located comprises (i) with said upper roll shifted to one side from a central position between said two lower rolls and while feeding the workpiece in a going path, rolling the workpiece by pressing the workpiece between said upper roll and said two lower rolls, and bending one end of the workpiece by pressing the one end between said upper roll and said two lower rolls, and then (ii) with said upper roll shifted to another side from the central position between said two lower rolls and while feeding the workpiece in a return path, rolling the workpiece by pressing the workpiece between said upper roll and said two lower rolls, and bending another end of the workpiece by pressing the another end between said upper roll and said two lower rolls.

15. The apparatus according to claim 12, wherein said control unit is for controlling said first, second and third actuators such that bending the workpiece under pressure of said upper roll and said two lower rolls such that the workpiece is formed into a pipe member having a required radius at a portion where the hole is located comprises (i) with said upper roll shifted to one side from a central position between said two lower rolls and while feeding the workpiece in a going path, rolling the workpiece by pressing the workpiece between said upper roll and said two lower rolls, and bending one end of the workpiece by pressing the one end between said upper roll and said two lower rolls, and then (ii) with said upper roll shifted to another side from the central position between said two lower rolls and while feeding the workpiece in a return path, rolling the workpiece by pressing the workpiece between said upper roll and said two lower rolls, and bending another end of the workpiece by pressing the another end between said upper roll and said two lower rolls.

16. The apparatus according to claim 11, wherein said control unit is for controlling said first, second and third actuators such that bending the workpiece under pressure of said upper roll and said two lower rolls such that the workpiece is formed into a pipe member having a required radius at a portion where the hole is located comprises (i) with said upper roll shifted to one side from a central position between said two lower rolls and while feeding the workpiece in a going path, rolling the workpiece by pressing the workpiece between said upper roll and said two lower rolls, and bending one end of the workpiece by pressing the one end between said upper roll and said two lower rolls, and then (ii) with said upper roll shifted to another side from the central position between said two lower rolls and while feeding the workpiece in a return path, rolling the workpiece by pressing the workpiece between said upper roll and said two lower rolls, and bending another end of the workpiece by pressing the another end between said upper roll and said two lower rolls.

17. The apparatus according to claim 16, wherein said control unit is for controlling said first, second and third actuators such that pressing the pipe member with said upper roll and said two lower rolls such that no bending action is applied to the portion where the hole is located, and such that the pipe member is rolled whereby other portions of the pipe member are made to have a radius coinciding with the radius at the portion where the hole is located, comprises feeding the pipe member in plural passes between said upper roll and said two lower rolls, with each of the passes corresponding to a step-wise reduction of a distance between said upper roll and said two lower rolls.

18. The apparatus according to claim 17, wherein said control unit is for controlling said first, second and third actuators such that (i) with said upper roll shifted to one side from a central position between said two lower rolls and while feeding the workpiece in a going path, (a) rolling the workpiece by pressing the workpiece between said upper roll and said two lower rolls comprises pressing the workpiece between said upper roll and said two lower rolls with said upper roll and two lower rolls being spaced by a first distance, and (b) bending one end of the workpiece by pressing the one end between said upper roll and said two lower rolls comprises pressing the workpiece between said upper roll and said two lower rolls with said upper roll and two lower rolls being spaced by a second distance which is less than the first distance, and (ii) with said upper roll shifted to another side from the central position between said two lower rolls and while feeding the workpiece in a return path, (a) rolling the workpiece by pressing the workpiece between said upper roll and said two lower rolls comprises pressing the workpiece between said upper roll and said two lower rolls with said upper roll and two lower rolls being spaced by the first distance, and (b) bending another end of the workpiece by pressing the another end between said upper roll and said two lower rolls comprises pressing the workpiece between said upper roll and said two lower rolls with said upper roll and two lower rolls being spaced by the second distance.

19. The apparatus according to claim 16, wherein said control unit is for controlling said first, second and third actuators such that (i) with said upper roll shifted to one side from a central position between said two lower rolls and while feeding the workpiece in a going path, (a) rolling the workpiece by pressing the workpiece between said upper roll and said two lower rolls comprises pressing the workpiece between said upper roll and said two lower rolls with said upper roll and two lower rolls being spaced by a first distance, and (b) bending one end of the workpiece by pressing the one end between said upper roll and said two lower rolls comprises pressing the workpiece between said upper roll and said two lower rolls with said upper roll and two lower rolls being spaced by a second distance which is less than the first distance, and (ii) with said upper roll shifted to another side from the central position between said two lower rolls and while feeding the workpiece in a return path, (a) rolling the workpiece by pressing the workpiece between said upper roll and said two lower rolls comprises pressing the workpiece between said upper roll and said two lower rolls with said upper roll and two lower rolls being spaced by the first distance, and (b) bending another end of the workpiece by pressing the another end between said upper roll and said two lower rolls comprises pressing the workpiece between said upper roll and said two lower rolls with said upper roll and two lower rolls being spaced by the second distance.

20. The apparatus according to claim 11, wherein said control unit is for controlling said first, second and third actuators such that pressing the pipe member with said upper roll and said two lower rolls such that no bending action is applied to the portion where said hole is located, and such that the pipe member is rolled whereby other portions of the pipe member are made to have a radius coinciding with the radius at the portion where the hole is located, comprises feeding the pipe member in plural passes between said upper roll and said two lower rolls, with each of the passes corresponding to a step-wise reduction of a distance between said upper roll and said two lower rolls.

* * * * *